US010051935B1

(12) United States Patent
Davison

(10) Patent No.: US 10,051,935 B1
(45) Date of Patent: Aug. 21, 2018

(54) MULTI-PATTERN PURSE SYSTEM

(71) Applicant: Jillian Marie Davison, North Huntngdon, PA (US)

(72) Inventor: Jillian Marie Davison, North Huntngdon, PA (US)

( * ) Notice: Subject to any disclaimer, the term of this patent is extended or adjusted under 35 U.S.C. 154(b) by 0 days.

(21) Appl. No.: 15/656,070

(22) Filed: Jul. 21, 2017

(51) Int. Cl.
*A45C 13/08* (2006.01)
*A45C 3/06* (2006.01)

(52) U.S. Cl.
CPC ..... *A45C 13/08* (2013.01); *A45C 3/06* (2013.01)

(58) Field of Classification Search
CPC ..... A45C 13/08; A45C 7/0045
USPC ..... 150/104, 111, 100, 150; 190/108
See application file for complete search history.

(56) References Cited

U.S. PATENT DOCUMENTS

| | | | | |
|---|---|---|---|---|
| 2,086,326 | A | 7/1937 | Goldberg | |
| 3,108,627 | A | 10/1963 | Tatelman | |
| 4,112,991 | A * | 9/1978 | Barbaresi | A45C 3/00 150/104 |
| 4,301,849 | A | 11/1981 | Litwack et al. | |
| 5,209,279 | A | 5/1993 | Wilson | |
| 5,509,515 | A | 4/1996 | Guo | |
| 5,725,039 | A | 3/1998 | Macinai et al. | |
| 5,873,504 | A | 2/1999 | Farmer | |
| 7,600,620 | B2 | 10/2009 | Hammond | |
| 7,607,461 | B2 | 10/2009 | Pace et al. | |
| 7,828,027 | B2 | 11/2010 | Mangano et al. | |
| D661,486 | S | 6/2012 | Vanderveer et al. | |
| 8,425,072 | B2 | 4/2013 | Hurwitz | |
| D731,788 | S | 6/2015 | Joo et al. | |
| 2007/0102077 | A1 | 5/2007 | Parker-Ogden | |
| 2007/0137959 | A1* | 6/2007 | Zauderer | A45C 3/08 190/110 |
| 2010/0012238 | A1* | 1/2010 | Lee | A45C 3/08 150/107 |
| 2010/0224294 | A1 | 9/2010 | Svenson | |
| 2011/0011503 | A1* | 1/2011 | Linda K. | A45C 3/08 150/104 |

(Continued)

FOREIGN PATENT DOCUMENTS

| | | |
|---|---|---|
| DE | 20302224 | 2/2003 |
| FR | 2840513 | 12/2003 |
| GB | 2476661 | 6/2011 |

*Primary Examiner* — Sue A Weaver
(74) *Attorney, Agent, or Firm* — Kevin P Weldon

(57) ABSTRACT

A carryall assembly which can be readily and rapidly altered so a user may select from a plurality of optional decorative fashion patterns. A decorative fashion changeable carryall includes multiple components for collective attachment in order to yield an interchangeable carryall. A carryall body that is larger than another carryall body. The smaller carryall is coupled to the larger carryall. While the carryall system is worn only one side, the outward facing side, of the carryall system may be made completely visible. The smaller carryall when coupled together with the larger carryall overlaps a substantial portion of the second larger carryall. The entire outwardly facing surface of the smaller carryall body is visible but only a portion of the outwardly facing surface of the larger carryall is visible. This outwardly visible portion of the larger carryall and the outwardly facing visible surface of the smaller carryall combine into a dual-pattern distinctive display.

20 Claims, 3 Drawing Sheets

(56) References Cited

U.S. PATENT DOCUMENTS

| | | | | |
|---|---|---|---|---|
| 2011/0056599 | A1* | 3/2011 | Cook | A45C 3/08<br>150/127 |
| 2012/0103481 | A1 | 5/2012 | Nieves | |
| 2015/0068651 | A1 | 3/2015 | Tekulve | |

* cited by examiner

MULTI-PATTERN PURSE SYSTEM

FIELD OF THE INVENTION

The present invention relates to the field of fashion articles and accessories, and more particularly to decorative fashion carryalls having multiple interchangeable patterns for customizing the appearance of an assembled carryall system.

BACKGROUND OF THE INVENTION

There is a need in the art for a woman to have the ability to quickly switch her carryall into various fashion patterns without having to remove and transfer articles inside one carryall into a carryall having a different fashion style.

Carryalls provide a user with a means for carrying personal property and other objects. Carryalls have been known and used by women for many years. As time has passed, demand for carryalls with displayed patterns has increased, such that carryalls which display a pattern have become common in the art.

Prior art decorative fashion changeable carryalls include multiple components for collective attachment in order to yield an interchangeable carryall. There is a need for a carryall which can be readily and rapidly altered such that a single carryall assembly can provide a user with a plurality of optional decorative fashion patterns.

While all of the aforementioned prior art constructions are more than adequate for the basic purpose and function for which they have been specifically designed, they are uniformly deficient with respect to their failure to provide a simple, efficient, and practical interchangeable decorative fashion carryall.

SUMMARY OF THE INVENTION

The present invention provides a multi-pattern carryall system comprising a larger carryall body and smaller carryall body, each having a receptacle therein formed by at least two interior surfaces. The system having at least four total exterior surfaces and at least three different patterns. Each carryall body comprising at least two external surfaces including a first surface having a first pattern and a second surface having another different pattern.

A multi-pattern carryall system having a carryall body that is larger than another carryall body. The smaller carryall is coupled to the larger carryall. While the carryall system is worn only one side, the outward facing side, of the carryall system may be made completely visible. The smaller carryall when coupled together with the larger carryall overlaps a substantial portion of the second larger carryall. The entire outwardly facing surface of the smaller carryall body is visible but only a portion of the outwardly facing surface of the larger carryall is visible. This outwardly visible portion of the larger carryall and the outwardly facing visible surface of the smaller carryall combine into a dual-pattern distinctive display.

A smaller carryall body comprising at least two external surfaces including a first surface having a first pattern and a second surface having a second different pattern. A larger carryall body further comprises a third surface and another opposite side fourth surface, the third surface and a fourth surface respectively having a third pattern and a fourth pattern. The carryall system therefore comprises four patterns, two of which are printed on the larger carryall body, and the other two patterns are printed on the smaller carryall body. Said four decorative fashion patterns may be oriented and configured into four different overlapping pattern combinations for selective display.

A carryall combination including at least two carryalls coupled together and typically worn on a persons shoulder. Each at least two carryall bodies has substantially two external surfaces, each surface has a different pattern. When said combined carryalls are worn on a woman's shoulder or perhaps as a cross-body bag, one external surface of the larger carryall faces inward toward the person and the other external surface faces visibly outward away from the person. The second smaller carryall when coupled on the outward side of the carryall system has one external face turned inward against the larger carryall and its other external surface faces visibly outward.

A multi-pattern carryall system can be reconfigured by unclasping a smaller carryall and a larger carryall from each other and then flipping over one or both carryalls to outwardly display a differently patterned surface. Upon selecting a desired pattern for display the smaller carryall is positioned on the larger carryall so that when the carryall system is worn or carried the selected pattern is the outwardly visible pattern.

One embodiment of an interchangeable carryall includes a multi-pattern surface carryall system comprising a smaller carryall having a first pattern disposed on a first surface and a second pattern disposed on a second surface of the smaller carryall, and a larger carryall having a third pattern disposed on a third surface and a fourth pattern disposed on a fourth surface of the larger carryall.

The invention provides a carryall multi-pattern system, the carryall multi-pattern system comprising a plurality of carryalls for configuring a desired pattern or surface on the outwardly facing visible surfaces of the carryall. Generally, each carryall includes one or more accessibility members to access receptacles within each carryall. The carryall system may have at least two desired patterns on at least two exterior surfaces of each carryall.

A multi-pattern carryall system a body carryall is larger than another carryall body. The smaller carryall is coupled to the larger carryall. While the carryall system is being worn, only one side, the outward facing side of the multi-pattern carryall system may be made completely visible. The smaller carryall when coupled together with the larger carryall overlaps a substantial portion of the second larger carryall. The entire outwardly facing surface of the smaller carryall body is visible but only a portion of the outwardly facing surface of the larger carryall is visible. This outwardly visible portion of the larger carryall along with the outwardly facing visible surface of the smaller carryall combine into a distinctive overlapping combined display.

This together with other objects and advantages which will become subsequently apparent reside in the details of construction and operation as more fully hereinafter described and claimed, reference being had to the accompanying drawings forming part hereof, wherein like reference numerals refer to like parts throughout.

BRIEF DESCRIPTION OF THE DRAWINGS

These and other attributes of the invention will become more clear upon a thorough study of the following description of the invention, particularly when reviewed in conjunction with the drawings, wherein.

DETAILED DESCRIPTION

The invention provides a carryall multi-pattern system, the carryall multi-pattern system comprising a plurality of carryalls for configuring a desired pattern on the outwardly facing visible surfaces of the carryall system.

For purposes of this invention, the term "carryall" is intended to describe a flexible bag-shaped body having a receptacle for receiving articles. Handbags, shoulder bags, clutch, wristlet, cross body, purses, laptop bags, diaper bags, and the like; hereinafter collectively referred to as "carryalls".

Figure 1:
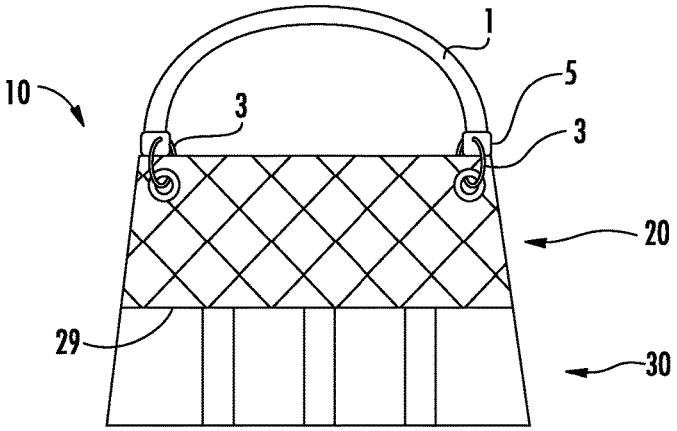
FIG. 1 is a side view of the outwardly facing visible decorative pattern of an assembled multi-pattern carryall system.

FIG. 1 illustrates an assembled carryall system of the present invention to be worn over the shoulder of woman. The carryall system having two patterns on two different carryalls combined together to form a distinctive decorative pattern. The carryall system may be easily reconfigured to display a different decorative pattern combination. The present invention carryall system allows for a woman to select one decorative pattern combination from multiple decorative pattern combinations to be displayed when the carryall system is worn.

Figure 2A:
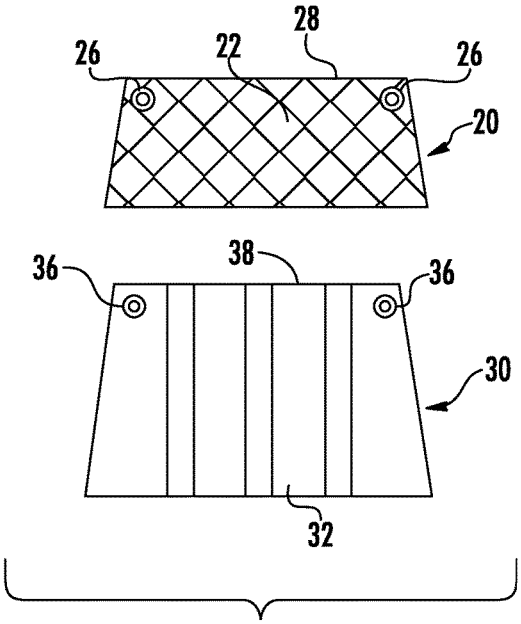
FIG. 2*a* is a partial disassembled illustration of the invention illustrating the carryalls.

The multi-pattern carryall system 10 includes a strap 1 having hoops 5 attached at both ends of the strap. A first carryall 20 and a second carryall 30. In FIG. 2*a* the smaller carryall 20 and larger carryall 30 are shown. The smaller carryall 20 has a diamond pattern on external first surface 22 and a top 28 having closure means (not shown) for securing the contents of the carryall.

Similarly, the larger carryall 30 has a vertical striped pattern on external third surface 32 and a top 38 having closure means (not shown) for securing the contents of the carryall. The carryalls 20, 30 may be opened for receiving articles by separating well-known closure means known in the art including but not limited to a zipper, Velcro (trademark), button, clasp, or other closure means known in the art.

The smaller carryall 20 has openings 26 at opposite ends of the carryall and the larger carryall 30 similarly has an openings 36 at opposite ends of that carryall. The linear distance between the openings 26 of the smaller carryall 20 is equal to the linear distance between the ring openings 36 on the larger carryall 30. A coupling means 3 as shown in FIG. 1 is employed to attach the smaller carryall 20 to the larger carryall 30. The coupling means 3 is also used for connecting strap 1 to the carryalls 20, 30. Suitable coupling means 3 that are well known in the art may be employed, including but not limited to a clasp, carabiner, snap, key ring or other coupling means known in the art that is relatively easy to fasten and unfasten.

In FIG. 1 the coupling means 3 is threaded through: a strap end hoop 5, opening 26 on the smaller carryall and opening 36 on the larger carryall. A second coupling means 3 is then threaded through: a strap end hoop 5 located at the opposite end of the strap 1, the other opening 26, as well as the other opening 36 at the opposite end of larger carryall.

Figure 2B:
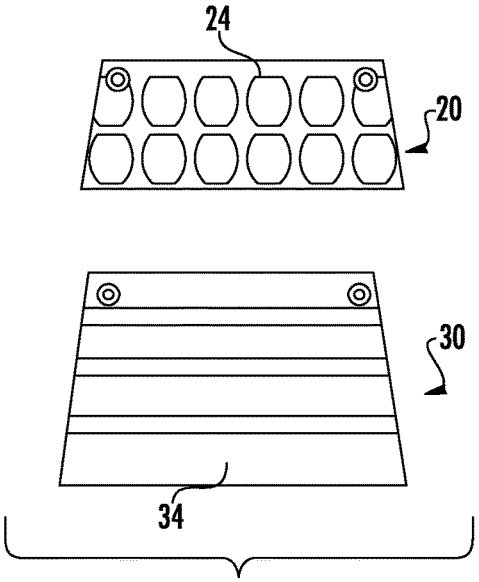
FIG. 2*b* is a partial disassembled illustration of the invention showing the opposite sides of the carryalls shown in FIG. 2*a*.

The individual surface patterns shown in FIG. 2*a* are the same patterns illustrated in FIG. 1. In the present invention, there are a total of basically four different carryall surfaces. The smaller carryall 20 has basically two surfaces; first surface 22, and second surface 24; and the larger carryall 30 basically has two surfaces: third surface 32, and fourth surface 34. These four surfaces 22, 24, 32 and 34 each have a decorative fashion pattern. And the carryall system 10 may have a uniquely different decorative pattern on each of these four surfaces. FIG. 2*b* illustrates the opposite side surfaces of both the smaller carryall 20 and larger carryall 30. In FIG. 2*b* the pattern on second surface 24 printed on the smaller carryall differs from the pattern on first surface 22. In FIG. 2*b* the pattern on the fourth surface 34 printed on the larger carryall differs from the third surface's 32 decorative pattern.

On the second page of the drawings of the instant invention all four possible decorative overlapping pattern combinations of the multi-pattern carryall system10 are exhibited. In the illustrated configurations it should be noted that no portion of the larger carryall is visible above the bottom 29 of the smaller carryall, the entire upper portion of the larger carryall is completely overlapped. With the carryall system 10, a woman may conveniently disassemble and reassemble the carryall system so as to exhibit a desired fashion pattern suitable for an occasion. Whenever a woman desires to change fashion she only needs to remove the strap 1 and coupling means 3 from the carryall multi-pattern system 10 and flip-over either the smaller or larger carryall, or flip-over both, thread and reattach the coupling means 3 once the openings 26 and 36 are aligned.

As can be seen with reference to FIGS. 3*a*-3*d*, the carryall of the present invention can be disassembled and reassembled to exhibit a multiple number of distinctively different decorative pattern combinations. As detailed above, in the illustrated embodiment of the invention two different decorative patterns are shown on the opposite reverse side surfaces 22, 24 of smaller carryall along with two more different decorative patterns on the larger carryall opposite reverse sides 32, 34. The alternative decorative pattern combinations can be quickly configured by a woman to display any one of these four different overlapping patterns 3*a*-3*d*.

Figure 3A:
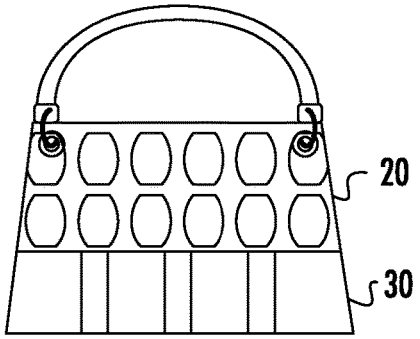
FIGS. 3*a*-3*d* show side views of the multi-pattern carryall system, each side view illustrates the same carryall system but configured in a different decorative overlapping pattern combination.
Figure 3C:
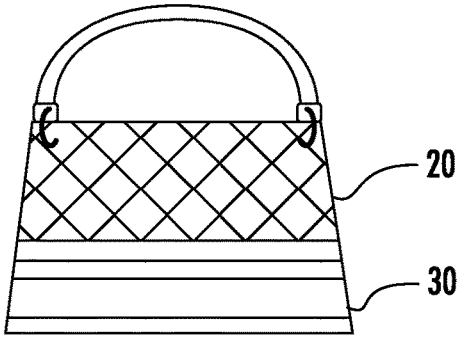
Figure 3B:
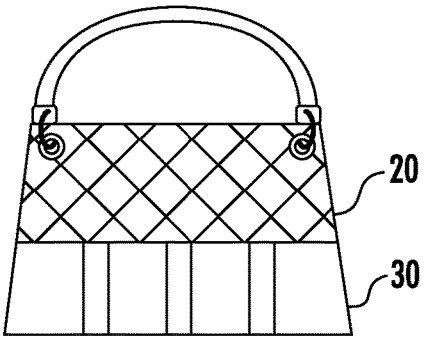

FIGS. 3*a* and 3*b* both illustrate the vertical stripes decorative pattern on the third surface 32 as the outwardly facing visible decorative pattern. In FIG. 3*a* the truncated oval pattern on the second surface 24 is selected as the outwardly facing visible decorative pattern. In FIG. 3*b* the diamond pattern printed on the first surface 22 is selected as the outwardly facing visible fashion pattern.

Figure 3D:
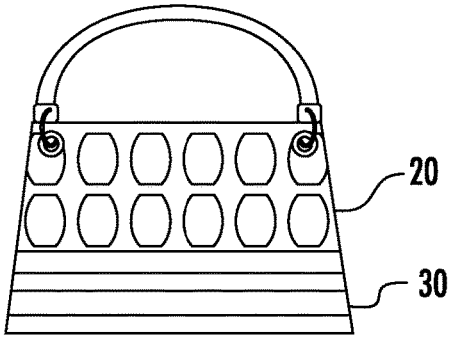

FIGS. 3*c* and 3*d* both show the horizontal stripes pattern of the fourth surface 34 on the larger carryall as the selected outwardly facing visible fashion pattern. In FIG. 3*c* the diamond pattern printed on the first surface 22 on the smaller carryall is selected as the outwardly facing visible fashion pattern. In FIG. 3*d* the truncated oval pattern printed on the second surface 24 of the smaller carryall is selected as the outwardly facing visible fashion pattern.

As it should be appreciated by an artisan in the industry the decorative patterns illustrated in the drawings should not be interpreted in anyway to limit the invention. For instance each of the four surfaces 22, 24, 32 and 34 may alternatively be just a different color. It is further contemplated that the four surfaces may each be two-toned, half of a carryall surface one color and the other half of the same surface a second color, for a total of eight different colors in the carryall system.

Likewise, it is contemplated that rather than one uniform repetitive pattern as shown in FIGS. 2*a* and 2*b*, instead each of the four surfaces be two separate repetitive patterns half of a surface one repetitious pattern and the other half a second repetitious pattern.

Further the carryall system may comprise of a smaller carryall or larger carryall in which one of the carryalls has only one decorative pattern on both exterior surfaces 22 and 24, or alternatively both 32 and 34 have the same decorative pattern for a total of two distinctive overlapping patterns not four distinctive overlapping patterns. It should be appreciated with only three different decorative patterns (one of the two carryalls bodies has the same decorative pattern on both sides) in such a carryall system there are only two selectable overlapping pattern combinations that may be displayed by a woman.

Figure 4:
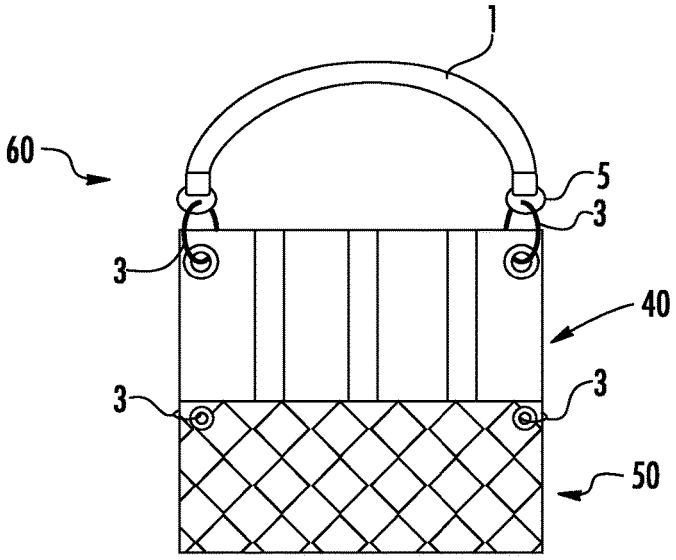
FIG. 4 is a side view of the outwardly facing visible decorative pattern of second embodiment of an assembled multi-pattern carryall system.

A second embodiment of a multi-pattern carryall system 60 of the present invention is illustrated in FIG. 4. The second embodiment is similar to the first embodiment illustrated in FIG. 1. The second embodiment however does not have a trapezoidal shape like the first embodiment. As shown in FIG. 4 the second embodiment side view has a rectangular shape. Both the smaller carryall 50 and larger carryall 40 have a rectangular shape. Also, in addition to the similar openings 46 located on the large carryall 40, the large carryall also has a second pair of openings 45 therein, as best seen in FIGS. 5*a* and 5*b*.

The second pair of openings 45 provide for attachment of the smaller carryall nearer the bottom of the large carryall, as shown in FIG. 4. A second pair of coupling means 3 is employed to attach the smaller carryall 20 onto a bottom portion of the larger carryall 40. The first pair of coupling means 30 is employed to connect a strap 1 onto the larger carryall 20.

Figure 5A:
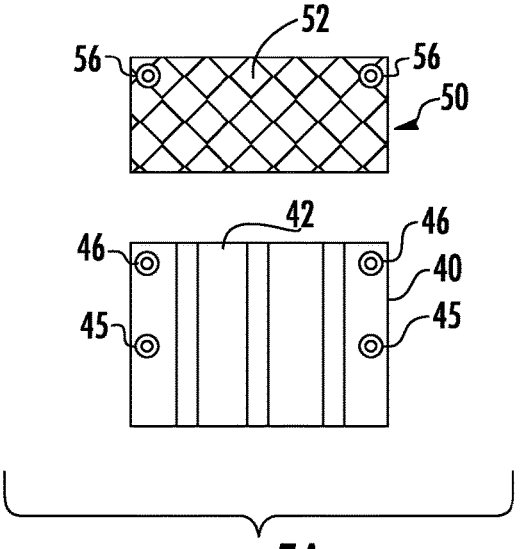
FIG. 5*a* is a partial disassembled illustration of the second embodiment of the invention illustrating the carryalls.
Figure 5B:
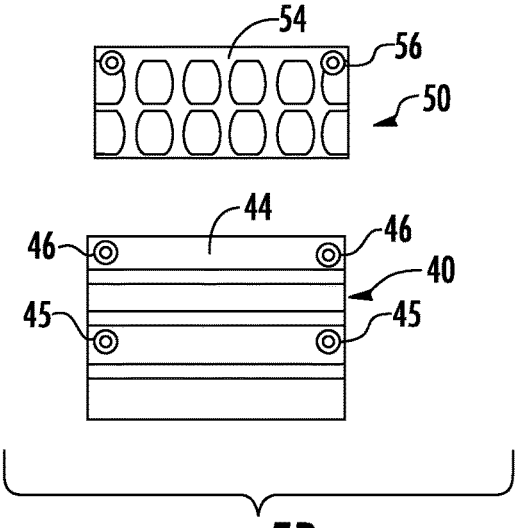
FIG. 5*b* is a partial disassembled illustration of the second embodiment of invention showing the opposite sides of the carryalls shown in FIG. 5*a*.

The individual surface patterns shown in FIG. 5*a* are the same patterns illustrated in FIG. 4. As in the first embodiment described above there are a total of basically four different carryall surfaces. The smaller carryall 50 has basically two surfaces; first surface 52, and second surface 54; and the larger carryall 40 basically has two surfaces: third surface 42, and fourth surface 44. These four surfaces each have a decorative fashion pattern.

As described above with respect to the first embodiment multi-pattern carryall system 60 of the second embodiment can be disassembled and reassembled to exhibit four distinctively different decorative pattern combinations, using the top openings 46. In addition, as shown in figure four the carryall system 60 can be configured using the lower openings 45 nearer the bottom of the larger carryall 40. It should be noted that although the same fashion patterns surfaces are exposed whenever the smaller carryall is only dropped from attachment at the top openings 46 and attached to the lower openings 45 makes for a different overall appearance of the carryall system 60.

As can be appreciated the smaller carryall 50 shown in FIG. 4 can be disconnected by releasing the coupling means 3 and flipped over to exhibit side 54 which has a different pattern. Alternatively, the larger carryall 40 in FIG. 4 may be disconnected from the smaller carry all 50 and flipped over to exhibit the pattern on the opposite surface 44. Or once disconnected both the smaller carryall 50 and larger carryall 40, in FIG. 4, can be flipped over to exhibit the patterns on the opposing sides, see FIG. 5*b*, and reconnected with the smaller carryall connected to the second lower pair of openings 45. Accordingly, the second embodiment multi-pattern carryall system 60 can be configured into eight different decorative pattern combinations.

Alternatively, in multi-pattern carryall system of the present invention embodiments one or more of the decorative patterns on one of the four surfaces can include a different decorative texture or decorative fabric. Further, each of the decorative patterns can be any artistic pattern.

Additionally, alternative straps or handles having different fashions may be employed with the multi-pattern carryall system 10. A woman simply disconnects both the strap hoops 5 from the multi-pattern carryall system 10 using the coupling means 3 and connects the end hoops 5 of another desired replacement strap/handle into the multi-pattern carryall system 10.

The present invention can be practiced using different shapes of carryalls known in the art, and is not limited to the illustrated trapezoidal and rectangular examples contained herein.

It is also contemplated that more than two smaller carryalls may be included into the multi-pattern carryall system of the second embodiment to permit for even a greater number of configurations.

Finally, it is contemplated that multiple additional openings may be formed along the side s of the larger carryall for attaching other personal items.

While particular embodiments of the present invention have been disclosed, it is to be understood that various modifications and combinations are possible and are contemplated within the true spirit and scope of the appended claims. There is no intention, therefore, of limitations to the exact abstract and disclosure herein presented. It will be understood that various omissions, modifications, substitutions and changes in the forms and details of the coating can be made by those skilled in the art without departing in any way from the spirit of the present invention.

The invention claimed is:

1. A multi-display carryall system comprising:

a smaller carryall body having a first surface and an opposite second surface, and a larger carryall body having a third surface and an opposite fourth surface, wherein said first surface, said second surface, said third surface and said fourth surface each have a decorative fashion design covering said four surfaces and said decorative fashion design on at least three of said four surfaces are different decorative fashion designs.

2. A multi-display carryall system according to claim 1, wherein each said decorative fashion design on said four surfaces are different decorative fashion designs.

3. A multi-display carryall system according to claim 1, further comprising:

coupling means, and said larger carryall body has a first pair of openings and said smaller carryall body has a pair of openings, wherein said coupling means attaches said smaller carryall body to said larger carryall body.

4. A multi-display carryall system according to claim 3, wherein said larger carryall body has a second pair of openings spaced below said first pair of openings.

5. A multi-display carryall system according to claim 3, wherein each said decorative fashion design on said four surfaces are different designs.

6. A multi-display carryall system according to claim 5, wherein said larger carryall body has a second pair of openings spaced below said first pair of openings.

7. A multi-display carryall system according to claim 4, wherein said smaller carryall body overlaps at least a part of an upper surface portion of said larger carryall body.

8. A multi-display carryall system according to claim 7, wherein said smaller carryall body completely overlaps the entire said upper surface portion of said larger carryall body.

9. A multi-display carryall system according to claim 7, wherein said smaller carryall body and said larger carryall body both have a trapezoid shape.

10. A multi-display carryall system according to claim 9, further comprising:

a strap for carrying said multi-display carryall system, wherein said strap is connected to said smaller carryall and said larger carryall with said coupling means.

11. A multi-display carryall system according to claim 1, wherein each said decorative fashion design is either printed, a texture or fabric.

12. A multi-display carryall system according to claim 1, wherein each said decorative fashion design is either a pattern, solid color or two-toned color.

13. A multi-display carryall system comprising:

coupling means a smaller rectangular carryall body having a first surface and an opposite second surface, and a larger rectangular carryall body having a third surface and an opposite fourth surface, wherein said first surface, said second surface, said third surface and said fourth surface each have a decorative fashion design covering said four surfaces and said decorative fashion design on at least three of said four surfaces are different decorative fashion designs, said larger carryall body has a first pair of openings and a second pair of openings below said first pair of openings, and said smaller carryall body has a pair of openings, wherein said coupling means attaches said smaller carryall body to said larger carryall body at said first pair of openings or at said second pair of openings.

14. A multi-display carryall system according to claim 13, wherein when said smaller carryall is attached to said first pair of openings said smaller carryall body overlaps at least a part of an upper surface portion of said larger carryall body.

15. A multi-display carryall system according to claim 14, wherein when said smaller carryall is attached to said first pair of openings said smaller carryall body completely overlaps the entire said upper surface portion of said larger carryall body.

16. A multi-display carryall system according to claim 13, wherein each said decorative fashion design on said four surfaces arc different decorative fashion designs.

17. A multi-display carryall system according to claim 16, further comprising:

a strap for carrying said multi-display carryall system, wherein said strap is connected to said larger carryall with said coupling means.

18. A multi-display carryall system comprising:

coupling means a smaller rectangular carryall body having a first surface and an opposite second surface, and a larger rectangular carryall body having a third surface and an opposite fourth surface, wherein said first surface, said second surface, said third surface and said fourth surface each have a decorative fashion design covering said four surfaces and said decorative fashion design on said four surfaces are different decorative fashion designs, said larger carryall body has a first pair of openings and a second pair of openings below said first pair of openings, and said smaller carryall body has a pair of openings, wherein said coupling means attaches said smaller carryall body to said larger carryall body at said first pair of openings or at said second pair of openings, wherein when said smaller carryall is attached to said second pair of openings said smaller carryall body completely overlaps a lower portion of a surface of said larger carryall body.

19. A multi-display carryall system according to claim 18, wherein when said smaller carryall is attached to said top first pair of openings said smaller carryall body completely overlaps the entire an upper portion of a surface of said larger carryall body.

20. A multi-display carryall system according to claim 19, further comprising:

a strap for carrying said multi-display carryall system, wherein said strap is connected to said larger carryall with said coupling means.

* * * * *